US011071184B1

(12) United States Patent
Chiodo et al.

(10) Patent No.: US 11,071,184 B1
(45) Date of Patent: Jul. 20, 2021

(54) SMART FLICKER-FREE PWM GENERATION FOR MULTI-CHANNEL LED DRIVERS

(71) Applicant: Infineon Technologies AG, Neubiberg (DE)

(72) Inventors: Rosario Chiodo, Selvazzano Dentro (IT); Adolfo De Cicco, Castel d'Azzano (IT); Pietro Vallese, Padua (IT)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 16/837,360

(22) Filed: Apr. 1, 2020

(51) Int. Cl.
*H05B 45/46* (2020.01)
*H05B 45/325* (2020.01)
*H05B 45/31* (2020.01)

(52) U.S. Cl.
CPC ..... *H05B 45/46* (2020.01); *H05B 45/325* (2020.01); *H05B 45/31* (2020.01)

(58) Field of Classification Search
CPC ..... H05B 45/46; H05B 45/325; H05B 45/31
See application file for complete search history.

(56) References Cited

U.S. PATENT DOCUMENTS 7,081,740 B2 * 7/2006 King ..... H02M 3/157 323/222
8,764,256 B2 * 7/2014 Foote ..... B60Q 1/38 362/494
2010/0222937 A1 * 9/2010 Nemesh ..... G05D 23/1912 700/300
2013/0162141 A1 * 6/2013 Kanda ..... H05B 45/00 315/77
2014/0022271 A1 * 1/2014 Lin ..... G09G 3/36 345/589
2016/0063929 A1 * 3/2016 Huang ..... H05B 45/24
2016/0307523 A1 * 10/2016 Huang ..... G05D 23/1912 700/300
2019/0114991 A1 * 4/2019 Selan ..... H05B 45/00 315/77
2020/0214097 A1 * 7/2020 Qiu ..... H05B 45/24

FOREIGN PATENT DOCUMENTS

FR 3001570 A1 * 8/2014 ..... G10K 15/02

OTHER PUBLICATIONS

"PWM Edge and Center Aligned Modes," retrieved from https://microchipdeveloper.com/pwr3101:pwm-edge-center-aligned-modes on May 13, 2020, website last updated May 8, 2020, 6 pp.

(Continued)

*Primary Examiner* — Borna Alaeddini
(74) *Attorney, Agent, or Firm* — Shumaker & Sieffert, P.A.

(57) ABSTRACT

The disclosure describes techniques for driving a plurality of light emitting diodes (LEDs) arranged in a parallel connection by using PWM (Pulse Width Modulation) dimming. The techniques of this disclosure describe the generation and application of a fixed phase shift map to a driver matrix based on pixel position. Each pixel corresponds to an LED light source. In the fixed phase shift map, each pixel will have a pre-defined phase shift calculated to induce a determined variation in turn-on time for geometrically neighbouring pixels to spread out current demand over time during PWM dimming.

21 Claims, 7 Drawing Sheets

(56) References Cited

OTHER PUBLICATIONS

ST., "STM32F7—Timers," Revision 1.0 retrieved from https://www.st.com/content/ccc/resource/training/technical/product_training/group0/2d/93/74/3f/33/83/47/95/STM32F7_WDG_TIMERS_GPTIM/files/STM32F7_WDG_TIMERS_GPTIM.pdf/jcr:content/translations/en.STM32F7_WDG_TIMERS_GPTIM.pdf on May 13, 2020, 61 pp.

Williams, "RGB LEDS: How to Master Gamma and Hue for Perfect Brightness," Hackaday, accessed from https://hackaday.com/2016/08/23/rgb-leds-how-to-master-gamma-and-hue-for-perfect-brightness/, Aug. 23, 2016, 4 pp.

U.S. Appl. No. 16/601,230, by Infineon Technologies. (Inventors: Unterweger et al.), filed Oct. 14, 2019.

U.S. Appl. No. 16/595,154, by Infineon Technologies. (Inventors: De Cicco et al.), filed Oct. 7, 2019.

* cited by examiner

| 0 | 1 | 2 | 3 | 4 | 5 | 6 | 7 | 8 | 9 |
|---|---|---|---|---|---|---|---|---|---|
| 7 | 0 | 0 | 0 | 0 | 0 | 0 | 0 | 0 | 0 |
| 6 | 0 | 0 | 20 | 30 | 50 | 50 | 30 | 20 | 0 |
| 5 | 0 | 30 | 100 | 150 | 170 | 170 | 150 | 30 | 20 |
| 4 | 0 | 100 | 500 | 600 | 700 | 700 | 600 | 250 | 20 |
| 3 | 0 | 100 | 500 | 800 | 900 | 1020 | 1020 | 950 | 250 |
| 2 | 0 | 100 | 500 | 800 | 900 | 1020 | 1020 | 900 | 200 |
| 1 | 0 | 50 | 100 | 400 | 700 | 800 | 900 | 800 | 100 |
| 0 | 0 | 20 | 30 | 100 | 200 | 400 | 400 | 300 | 50 |

300

306

Fixed Phase Shift -

| R/C | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 7 | 769 | 773 | 777 | 781 | 785 | 789 | 793 | 797 | 801 | 805 | 809 | 813 | 817 | 821 | 825 | 829 |
| 6 | 513 | 517 | 521 | 525 | 529 | 533 | 537 | 541 | 545 | 549 | 553 | 557 | 561 | 565 | 569 | 573 |
| 5 | 257 | 261 | 265 | 269 | 273 | 277 | 281 | 285 | 289 | 293 | 297 | 301 | 305 | 309 | 313 | 317 |
| 4 | 1 | 5 | 9 | 13 | 17 | 21 | 25 | 29 | 33 | 37 | 41 | 45 | 49 | 53 | 57 | 61 |
| 3 | 768 | 772 | 776 | 780 | 784 | 788 | 792 | 796 | 800 | 804 | 808 | 812 | 816 | 820 | 824 | 828 |
| 2 | 512 | 516 | 520 | 524 | 528 | 532 | 536 | 540 | 544 | 548 | 552 | 556 | 560 | 564 | 568 | 572 |
| 1 | 256 | 260 | 264 | 268 | 272 | 276 | 280 | 284 | 288 | 292 | 296 | 300 | 304 | 308 | 312 | 316 |
| 0 | 0 | 4 | 8 | 12 | 16 | 20 | 24 | 28 | 32 | 36 | 40 | 44 | 48 | 52 | 56 | 60 |

302

304

FIG. 3

SMART FLICKER-FREE PWM GENERATION FOR MULTI-CHANNEL LED DRIVERS

TECHNICAL FIELD

The disclosure relates to circuits for powering and controlling light emitting diode arrays.

BACKGROUND

Driver circuits may be used to control a voltage, current, or power at a load. For instance, a light emitting diode (LED) driver may control the power supplied to a string of light emitting diodes. Some drivers may comprise a DC to DC power converter, such as a buck-boost, buck, boost, or another DC to DC converter. Such DC to DC power converters may be used to control and possibly change the power at the load based on a characteristic of the load. DC to DC power converters may be useful for LED drivers to regulate current through LED strings.

Some LED lighting circuits may include many individually controllable LEDs arranged in a two-dimensional matrix, similar to an arrangement of LEDs in an LED display monitor. Individually controllable LEDs in the matrix of LEDs may be controlled to provide advanced lighting effects, for example in vehicle headlamp systems. Some headlamp systems may feature multiple and pixelated light sources allowing the individual brightness control of each pixel or pixel groups. The individual pixel control may enable new light functions such as glare free high beam systems, ADB (Adaptive Driving Beam) as well as symbol projection. To provide such a kind of functionality may use the generation of a dynamical high resolution light projected to the entire field of view of the driver. Advanced lighting effects associated with vehicle operation can be used to improve the driving experience and to promote vehicle safety. These functions may use matrix beams with a large number of LEDs and a fine pixel to pixel pitch.

SUMMARY

In general, the disclosure describes techniques for driving a plurality of light emitting diodes (LEDs) arranged in a parallel connection by using pulse modulated dimming. The techniques of this disclosure describe the generation and application of a fixed phase shift map to a driver matrix based on pixel position. Each pixel corresponds to an LED light source. In the fixed phase shift map, each pixel will have a pre-defined phase shift calculated to induce a determined variation in turn-on time for geometrically neighbouring pixels to spread out current demand over time during PWM dimming.

In one example, the disclosure is directed to a system comprising: a controller unit configured to output a signal comprising a light pattern, an LED unit comprising a plurality of pixel driver circuits, wherein each pixel driver circuit is associated with a respective pixel in the pixel matrix, and LED control circuitry comprising: an input interface configured to receive the signal comprising the light pattern, wherein the light pattern includes a pixel-matrix duty-cycle map with a plurality of first duty-cycle values, and processing circuitry configured to: apply a fixed phase shift map to each first duty-cycle value of the plurality of first duty cycle values. Each entry in the fixed phase shift map is associated with each respective pixel in the LED pixel-matrix according to a geometrical position of each respective pixel in the LED pixel-matrix. The processing circuitry is further configured to generate a pixel driving matrix comprising a plurality of shifted duty-cycle values, wherein each shifted duty-cycle value is based on each first duty-cycle value and the fixed phase shift map, and output the pixel driving matrix, to the plurality of pixel driver circuits.

In another example, a circuit comprising: an input interface configured to receive a signal comprising a light pattern, wherein the light pattern comprises a pixel-matrix duty-cycle map for an LED pixel matrix that includes a plurality of first duty-cycle values, a plurality of pixel driver circuits, wherein each pixel driver circuit is associated with a respective pixel in the pixel matrix, processing circuitry configured to: apply a fixed phase shift map to the received pixel-matrix duty-cycle map. Each entry in the fixed phase shift map is associated with each respective pixel in the LED pixel-matrix according to a geometrical position of each respective pixel in the LED pixel-matrix. The processing circuitry is further configured to generate a pixel driving matrix comprising a plurality of shifted duty-cycle values, wherein each shifted duty-cycle value is based on each first duty-cycle value and the fixed phase shift map, and output the pixel driving matrix to the plurality of pixel driver circuits.

In another example, the disclosure is directed to method comprising: receiving, by LED control circuitry, a light pattern, wherein the light pattern comprises a pixel-matrix duty-cycle map that includes a plurality of first duty-cycle values, and applying, by the LED control circuitry, a fixed phase shift map to the pixel-matrix duty-cycle map. Each entry in the fixed phase shift map is associated with a respective pixel in an LED pixel-matrix, and wherein each respective pixel is associated with a respective pixel driver circuit. The method further comprises generating, by the LED control circuitry, a pixel driving matrix comprising a plurality of shifted duty-cycle values, wherein each shifted duty-cycle value is based on each first duty-cycle value and the applied fixed phase shift map.

The details of one or more examples of the disclosure are set forth in the accompanying drawings and the description below. Other features, objects, and advantages of the disclosure will be apparent from the description and drawings, and from the claims.

BRIEF DESCRIPTION OF DRAWINGS

FIG. 3 is a table illustrating an example fixed phase shift map based on a pixel geometrical position of a pixel-matrix according to one or more techniques of this disclosure.

DETAILED DESCRIPTION

The disclosure describes techniques for driving a plurality of light emitting diodes (LEDs) arranged in a parallel connection by using pulse modulated dimming. The techniques of this disclosure describe calculation of a fixed phase shift map for the driver matrix based on pixel position. Each pixel corresponds to an LED light source. In the fixed phase shift map technique, each pixel may have a predefined phase shift calculated to induce a determined variation in turn-on time for geometrically neighbouring pixels to avoid a large current load step by spreading current demand over time during pulse modulated dimming.

Some LED lighting applications may include a high number of pixels along with spatial continuity properties of projected images, may result in adjacent pixels commonly having similar duty-cycles. One example area of application may include the modern vehicle LED front lighting, which may feature multiple and pixelated light sources allowing the individual brightness control of each pixel or pixel groups. In these or other applications, a large number of parallel connected LEDs may lead to a large load step in current demand when a large number of pixels are switched on or off at the same time. A DC-DC power converter may supply the power to the driver matrix for the pixelated light source. A large load step in current may lead to high ripple voltage, output voltage drop, electro-magnetic interference (EMI) caused by a fast slew-rate of the load step and increased cost to provide a DC-DC converter that can supply such a large load step of current. The techniques of this disclosure spread the current demand over time to reduce the large load step, and in addition may avoid flicker and other undesirable effects that may be caused by other techniques used to spread current demand over time.

Figure 1:
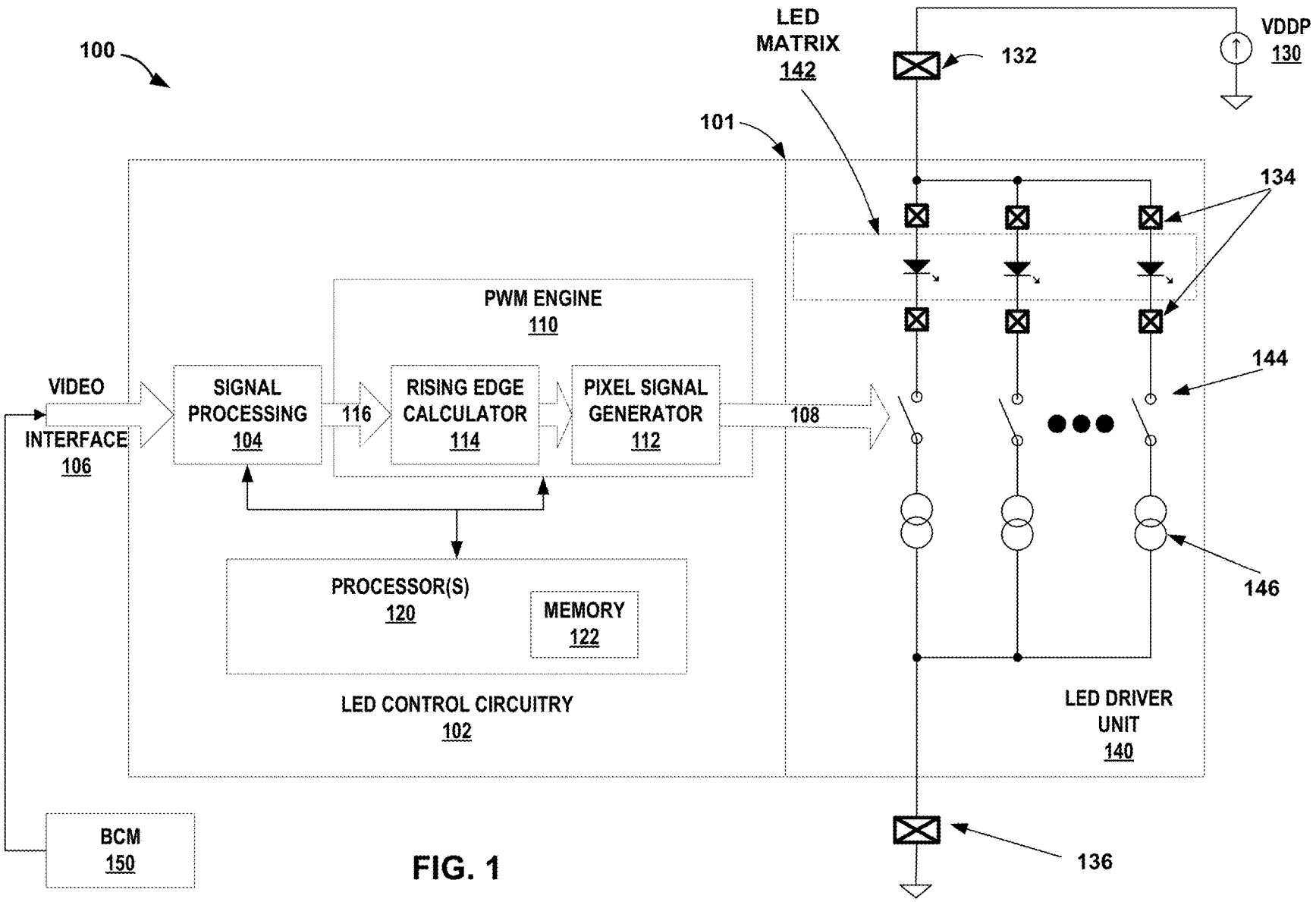
FIG. 1 is a block diagram illustrating an example system including circuitry for driving a plurality of LEDs according to one or more techniques of this disclosure.

FIG. 1 is a block diagram illustrating an example system including circuitry for driving a plurality of LEDs according to one or more techniques of this disclosure. The plurality of LEDs may be arranged in a pixel matrix and configured to project selected images formed by patterns of light. System 100 may be configured to receive an image from a controller unit and regulate the amount of power provided to each LED pixel in the pixel-matrix such that the pixel-matrix projects the desired light pattern. System 100 may regulate the amount of power, and therefore, control the brightness, of each LED pixel by PWM dimming for each LED pixel. A longer duty cycle for one LED pixel may result in a brighter output for that LED pixel when compared to a shorter duty cycle that results in a less bright output.

In the example of FIG. 1, system 100 includes a controller unit, such as a body control unit BCM 150, connected to an input of LED unit 101. LED unit 101 receives power from power supply VDDP 130 via connector 132 and connects to system ground via connector 136. LED unit 101 includes LED control circuitry 102 and LED driver unit 140. In some examples, LED unit 101 is a single circuit comprising LED control circuitry 102 and LED driver unit 140. In some examples, LED unit 101 may be a single integrated circuit (IC) with LED control circuitry 102 and LED driver unit 140 and connectors 132 and 136, as well as video interface 106 to couple to other components of system 100. In other examples, LED control circuitry 102 and LED driver unit 140 may be separate circuits, including separate integrated circuits, that may form LED unit 101 when connected together.

Further, although the example of FIG. 1 depicts various blocks within LED control circuitry 102, e.g. signal processing 104 and pixel signal generator 112, these blocks are depicted for convenience and to simplify the explanation of techniques of this disclosure. In other examples, however, the functions of LED control circuitry 102 may be combined or split into other blocks not shown in FIG. 1. Also, to simplify the description, this disclosure may focus on pulse width modulation (PWM) as the modulation scheme to control LED dimming. However, any pulse modulation technique, such as pulse frequency modulation (PFM) and pulse density modulation (PDM), may be used with the techniques of this disclosure.

BCM 150 is one example of a controller unit in a vehicle that may be configured to output a signal to video interface 106 comprising a light pattern. In other examples, a vehicle may have a controller unit separate from the body control unit to provide the light pattern to LED unit 101. In other systems, such as a building, which may include emergency lighting, display lighting and other lighting systems, a controller unit that may provide lighting patterns to LED unit 101 may be implemented as a central building controller and communicate via wired or wireless signals to LED unit 101.

LED driver unit 140, in the example of FIG. 1, may be configured to connect to an LED matrix 142 via connectors 134. LED matrix 142 may also be referred to as a pixel-matrix or an LED pixel-matrix in this disclosure. Each pixel in LED matrix 142 may be implemented with an LED. LED driver unit 140 may include a plurality of pixel driver circuits with each pixel driver circuit associated with a respective pixel in the pixel-matrix. Each pixel driver circuit of the plurality of pixel driver circuits, in the example of FIG. 1 is implemented with a switch 144, a current driver circuit 146 and one or more connectors 134. In other examples, pixel driver circuits in LED driver unit 140 may include more or fewer components, such as temperature sensors, current or voltage sensors, protection circuitry such as for overvoltage and overcurrent protection and other components not shown in FIG. 1. In some examples connectors 134 may be configured to electrically and mechanically connect to LED matrix 142. In this matter, a LED unit 101 may be configured to operate a variety of different types of LED matrix 142, which may provide the benefit of a single model of LED unit 101 able to be used in a variety of different applications and be configured to work with a specific load driving application.

System 100 may further include LED control circuitry 102, which includes an input interface at video interface 106 configured to receive the signal comprising the light pattern. The light pattern may include a pixel-matrix duty-cycle map with a plurality of duty-cycle values that when applied to LED matrix 142, output the desired light pattern. LED control circuitry 102 may include one or more sets of processing circuitry including signal processing circuitry 104, PWM engine 110 and one or more processors 120.

Processors 120 may be operatively coupled to memory 122. In some examples, processors 120 may receive input signals and send control signals to perform the operations of LED, such as communicate with BCM 150. In other examples, LED control circuitry 102 may include only signal processing 104 and PWM 110 without processors 120.

Examples of processing circuitry, such as processors 120, signal processing 104, rising edge calculator 114 and pixel signal generator 112 in LED control circuitry 102 may include any one or more of a microcontroller (MCU), e.g. a computer on a single integrated circuit containing a processor core, memory, and programmable input/output peripherals, a microprocessor (μP), e.g. a central processing unit (CPU) on a single integrated circuit (IC), a controller, a digital signal processor (DSP), an application specific integrated circuit (ASIC), a field-programmable gate array (FPGA), a system on chip (SoC) or equivalent discrete or integrated logic circuitry. A processor may be integrated circuitry, i.e., integrated processing circuitry, and that the integrated processing circuitry may be realized as fixed hardware processing circuitry, programmable processing circuitry and/or a combination of both fixed and programmable processing circuitry. Accordingly, the terms "processing circuitry," "processor" or "controller," as used herein, may refer to any one or more of the foregoing structures or any other structure operable to perform techniques described herein.

Examples of memory 122 may include any type of computer-readable storage media. Computer-readable storage media may include random access memory (RAM), e.g., SRAM. DRAM, etc., read only memory (ROM), programmable read only memory (PROM), erasable programmable read only memory (EPROM), electronically erasable programmable read only memory (EEPROM), flash memory, and similar devices. In some examples the computer readable storage media may store instructions that cause the processing circuitry to execute the functions described herein. In some examples, the computer readable storage media may store data, such as configuration information, temporary values and other types of data used to perform the functions of this disclosure.

Processing circuitry of LED control circuitry 102 may be configured to apply a fixed phase shift map to the pixel-matrix duty-cycle map received at video interface 106 from BCM 150. The fixed phase shift map may shift each duty-cycle value of the duty cycle values in the pixel-matrix duty-cycle map. The shift in the duty cycle may change the start-time of the duty cycle for a particular pixel, but does not change the duty cycle length, and therefore does not change the pixel brightness. As described above, in systems in which all the pixels of the pixel-matrix are turned on at the same time, power supply VDDP 130 may be required to provide large surge of current at the start of each PWM cycle. Providing the large surge of current may result in a voltage drop at the beginning of each PWM cycle. In some examples, the voltage drop on DC/DC output may be caused by a limited bandwidth such that the power supply cannot recover in time to the target regulated voltage before the next PWM cycle. To avoid a voltage drop, VDDP 130 may be sized to minimize the voltage drop, which may require a large and expensive power supply to manage the fast transient of the current, as well as wiring and connectors sized to handle the current surge. Other issues caused by the large load step at each PWM cycle may include a high ripple voltage caused by parasitic resistance and inductance of the wire-harness which connects the printed circuit board (PCB) or caused by high equivalent series resistance (ESR) of filter capacitance. In some examples, the transients may also cause electromagnetic emissions due to fast slew-rate of the load step resulting in electromagnetic compatibility (EMC) issues with other portions of system 100. Applying the fixed phase shift map of this disclosure to the received pixel-matrix duty-cycle map that defines a light pattern may spread the turn-on times of the pixels over time to avoid a large load step at a single time.

In accordance with the techniques of this disclosure, each entry in the fixed phase shift map may be associated with each respective pixel in the LED pixel-matrix according to a geometrical position of each respective pixel in the LED pixel-matrix. The techniques of this disclosure generate a fixed phase shift map based on geometrical position because of the high number of pixels in a pixel-matrix and spatial continuity properties of projected images. In this disclosure, the spatial continuity refers to the property that adjacent pixels commonly have similar duty cycles. In some examples, a small number of LEDs describing boundaries of the projected shapes may not have similar duty cycles, but with the exception of image boundaries, adjacent pixels may have a similar brightness and therefore a similar duty cycle value.

PWM engine 110 may apply the phase shift map to the received pixel-matrix duty-cycle map to generate pixel driving matrix 108. Pixel driving matrix 108 may include a plurality of shifted duty-cycle values. Each shifted duty-cycle value may be based on each received duty-cycle value as shifted by the values in the fixed phase shift map. In other words, each shifted duty-cycle value in pixel driving matrix 108 is based on each duty-cycle value in the map received by PWM engine 110 and the fixed phase shift map. PWM engine 110 may output the pixel driving matrix 108 to the plurality of pixel driver circuits of LED driver unit 140. In turn, LED driver unit 140 may open and close switches 144 as directed by pixel driving matrix 108 such that each LED pixel in LED matrix 142 outputs the desired brightness, while at the same time spreading the on-time of each duty cycle over a PWM period to avoid a large load step. In other words, the plurality of pixel driver circuits of LED driver unit 140 with the plurality of switches 144 are configured such that a respective switch is electrically coupled to a respective pixel of the pixel matrix, LED matrix 142, and a brightness output of each respective pixel of the pixel matrix is based on the shifted duty-cycle value associated with each pixel as defined by pixel driving matrix 108. As described above, the functions of PWM engine 110 may apply to other pulse modulation schemes and is not limited to pulse-width modulation.

The phase shift map of this disclosure may be based on the arrangement of the pixels in the pixel-matrix. In some examples, the phase shift map may be generated once, for example, during a manufacturing process and stored in LED control circuitry 102. In other examples, the phase shift map may be fixed based on the arrangement of the pixels and may be dynamically corrected for each PWM cycle. In some examples, the phase shift map may be stored in memory 122 and applied to the received image pattern by communication between processors 120 and PWM engine 110. In other examples, the phase shift map may be stored in PWM engine 110, such as in rising edge calculator 114 or pixel signal generator 112 and applied by the processing circuitry of either rising edge calculator 114 or pixel signal generator 112 to the received duty cycle entries of the pixel-matrix duty-cycle map that defines the light pattern.

In some examples, LED control circuitry 102 may generate a fixed phase shift map for a specific pixel matrix, for example based on the number of rows and columns of pixels, based on the number of sections of pixels within a pixel-matrix and other characterizes of the pixel-matrix. In other examples, some other processing circuitry, either within system 100, or during manufacturing may generate the fixed phase shift map. One example technique to generate the fixed phase shift map may include generating the fixed phase shift map by calculating a phase shift for each pixel geometrical position in the LED pixel-matrix according to:

$$\text{Phase}_{shift_{x,y}}=F3[F1(x)+F2(y)] \quad [1]$$

In equation [1], for each pixel geometrical position (x,y):

x indicates a row of the pixel geometrical position, y indicates a column of the pixel geometrical position, F1(x) comprises a first function based on a pixel row position, F2(y) comprises a second function based on a pixel column position, and F3[ . . . ] comprises a third function, such as square root, modulus, sum or some other function.

An example technique to generate a phase shift map that is fixed based on pixel geometrical position and dynamically adjusted may include generating each entry in the fixed phase shift map according to:

$$Phase_{Shift_{x,y}} = \mathrm{mod}\left[\left(x*\Delta PS_x + y*\Delta PS_y + \frac{\mathrm{mod}(y;2^A)}{4}\right) + \Delta PS_{cycle};2^B\right] \quad [2]$$

In equation [2] for each pixel geometrical position (x,y):

x indicates a row of the pixel geometrical position, y indicates a column of the pixel geometrical position, ΔPScycle is a dynamic correction of phase shift for each PWM cycle, ΔPSx comprises a constant phase shift change for each row, ΔPSy comprises a constant phase shift change for each column, mod(M;N) comprises calculate the modulus of M divided by N, $2^A$ indicates a quantity of pixels in a row, and $2^B$ indicates a quantity of pixels in a column. Also, F3[ . . . ] described above for equation [1] is the modulus, i.e. mod[ . . . ] for equation [2]. In some examples, there may be no dynamic adjustment and therefore ΔPScycle=zero.

In operation, BCM 150 may send signals including an image at every refresh period to LED unit 101 via video interface 106. A refresh period may be defined based on the characteristics of system 100. A refresh period may be based on a 60 Hz, 75 Hz, 144 Hz or some other periodic interval. In some examples BCM 150 may send the same image repeatedly for multiple refresh periods. For example, for an automobile traveling down a straight road for several minutes, with no oncoming traffic, BCM 150 may repeatedly send the same image to illuminate the scene. If the automobile systems detect an oncoming vehicle, BCM 150 may send a different image to change the light pattern, which may avoid illuminating the oncoming vehicle.

In some examples, LED control circuitry may perform other signal processing on the received pixel-matrix duty-cycle map. For example, signal processing circuitry 104 may apply one or more corrections to each of the plurality of original duty-cycle values received from BCM 150. An example correction may include a gamma correction to account for a nonlinear brightness perception by the eye, which includes a greater sensitivity to relative differences between darker tones than between lighter tones. In some examples, a gamma correction may be implemented by a look-up table (LUT).

In some examples, signal processing circuitry 104 may also convert each original duty-cycle value in the received pixel-matrix duty-cycle map to a second duty-cycle value, in which the second duty-cycle values may have a different resolution than the original duty-cycle values. For example, BCM 150 may output original duty cycle values based on an 8-bit value and signal processing circuitry 104 may output a matrix of duty cycle values 116 to PWM engine 110 that are higher or lower resolution. For example, duty cycle values 116 may be output to PWM engine 110 as 10-bit values. Signal processing circuitry 104 may also include a frame buffer or other signal processing functions.

LED control circuitry 102 may be configured to drive LED matrix 142 based on the same duty cycle received from BCM 150 without corrupting or changing the duty cycle input from video interface 106. For example, when converting the original duty cycle values from 8-bit to 6-bit or to 10-bit, the duty cycle and the resulting brightness of a pixel in LED matrix 142 may be approximately the same as the original (8-bit) value. That is the amount of time on and time off for each entry should stay approximately constant between the original duty cycle values and the values output 116 to PWM engine 110, but the resolution may change, i.e. increase (10-bit) or decrease (6-bit).

The techniques of this disclosure may provide several advantages over other techniques for spreading the on-times of each pixel over time to avoid a high load step. For example, a center based PWM scheme may manage pixels with a driving scheme centering all activation periods (duty-cycles) around the midpoint of the PWM period ($T_{PWM}$). A center based PWM scheme may avoid a large amount of pixels turn-on and turn-off at the same time granting gradual currents ramps. However, the total current is not averaged during a PWM period and it always reaches a maximum in an interval near the center of each PWM. Also, with a center based PWM scheme there is no control to avoid a large difference between the minimum and maximum supply currents during the PWM period.

In other examples, such as for multi-channel LED drivers with approximately uniform loads, i.e., all pixels with approximately the same typical driving current $I_{LED}$, another technique for supply current leveling may include an adaptive phase shift PWM scheme. In some examples of an adaptive phase shift scheme an algorithm arranging pixels activation delay, i.e., a PWM phase shift, may result in almost constant and averaged current consumption throughout the full PWM cycles for each requested light pattern. In such a scheme, for every refresh cycle with a new light pattern, the technique causes the drivers to dynamically rearrange the single pixels phase shifts. The outcome includes to activate each pixel when the previous pixel is deactivated. The adaptive phase shift PWM scheme may result in a power supply that will output an overall average supply current corresponding to the average DC current of the light pattern in execution and multiplied by total number of pixels in the pixel-matrix along with the selected driving current $I_{LED}$. An adaptive phase shift PWM scheme may avoid current overshoot by drawing only an average current expected in the full PWM cycle. By avoiding overshoot adaptive phase shift PWM scheme may avoid the need for expensive, high capacity external components of a DC/DC converter as well as predictable and manageable current steps for each new light pattern refresh along with improved EMC performances when compared to the high load step (dI/dt) of other schemes. However, in some examples an adaptive phase shift PWM scheme may result in an optically visible flicker for some pixels at lower PWM frequencies and at large variations in phase shift (ΔPS).

In contrast, the fixed phase shift map based on pixel geometrical position of this disclosure may avoid optically visible flicker because each pixel has a controlled phase shift, even during dynamic adjustment (ΔPScycle≠zero). Other advantages of the techniques of this disclosure may include the maximum current for a given PWM cycle ($T_{PWM}$) may be approximately the average current for a variety of commonly used light patterns. As described above, the fixed phase shift map may optimize the external components of power supply DC/DC, e.g. VDDP 130 by reducing the size, capacity and cost when compared to techniques that require a large load step. In addition, the techniques of this disclosure may involve lower computational complexity compared to other techniques and may enable a lower power dissipation for the system which can regulate the power supply because a maximum current requirement for system 100 may be close to an expected mean current for the system.

The techniques of this disclosure may also result in simplified thermal management control for system 100 because over the PWM period the junction temperatures for the system may only face moderate changes over time. Managing the duty cycle start times may result in reduced average current and therefore reduced peaks of current and power. Peaks in power drawn by the system may result in temperature spikes, which may require complex and expensive thermal management, such as heat sinks, fans and similar components to protect the system. However, the techniques of this disclosure may result in reduced temperature peaks and so may use less expensive thermal management as well as improve reliability because of reduced malfunctions and fewer automatic system safety shutdowns if temperatures exceed a temperature threshold. Additionally the techniques of this disclosure may result in improved EMC performances for generally low dI/dt, when compared to other techniques.

Figure 2C:
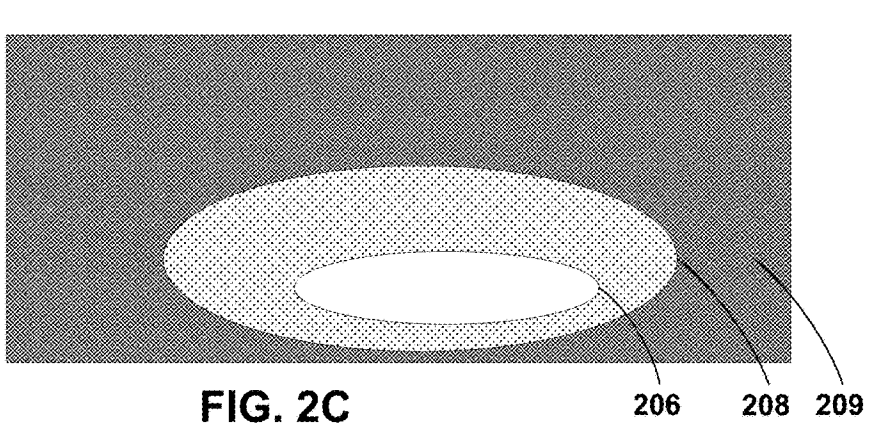
FIG. 2C is a conceptual diagram illustrating an example light pattern that may be output by a pixel-matrix comprising a plurality of LED pixels.
Figure 2D:
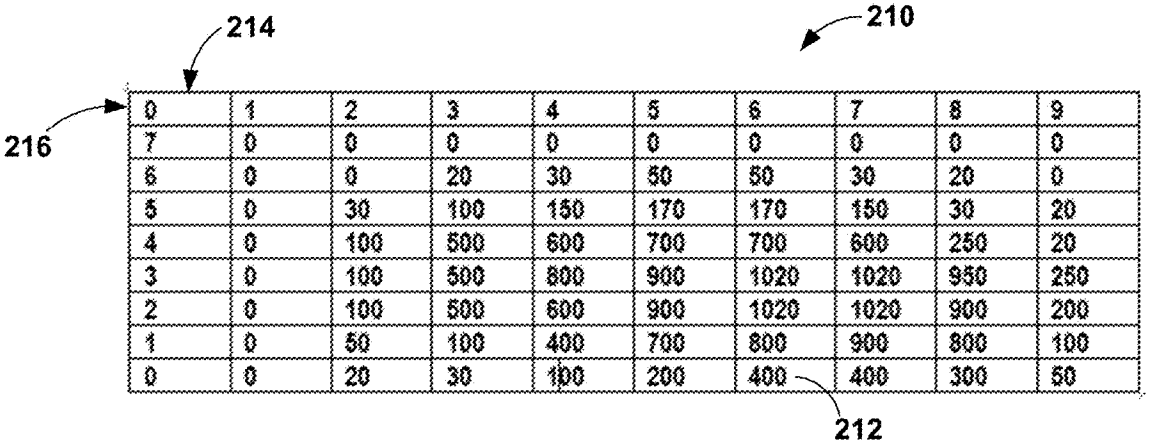
FIG. 2D is a table illustrating an example pixel-matrix duty-cycle map with a plurality of duty-cycle values that may be used to generate the light pattern as depicted in FIGS. 2B and 2C.
Figure 2A:
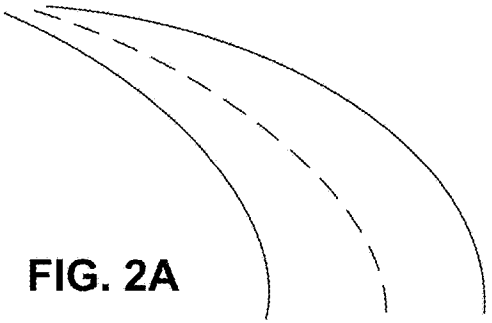
FIG. 2A is a conceptual diagram of a road curving to the left.

FIG. 2A is a conceptual diagram of a road curving to the left. A vehicle with a standard headlight that is not adaptive to changing conditions may illuminate much of the right side of the roadway, while in the curve, leaving the curved portions of the roadway in the dark.

Figure 2B:
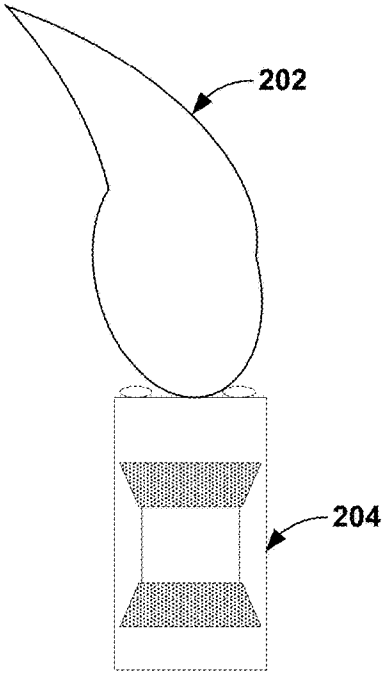
FIG. 2B is a conceptual diagram illustrating a top-down view of a vehicle that outputs a light pattern to conform to a road curving to the left as shown in FIG. 2A.

FIG. 2B is a conceptual diagram illustrating a top-down view of a vehicle that outputs a light pattern to conform to a road curving to the left as shown in FIG. 2A. In contrast, a vehicle with an automotive LED front lighting, which features multiple and pixelated light sources that allow the individual brightness control of each pixel or control of pixel groups may enable light functions such as glare free high beam systems, ADB (Adaptive Driving Beam) as well as symbol projection. To provide such functionality the techniques of this disclosure may allow generation of a dynamic, high resolution light projected to the entire field of view of the driver. For example, one or more pixel-matrices of LEDs on vehicle 204 may project a light pattern 202 that illuminates portions of the roadway in FIG. 2A along the curve without unnecessarily illuminating the portions off the roadway to the right.

FIG. 2C is a conceptual diagram illustrating an example light pattern that may be output by a pixel-matrix comprising a plurality of LED pixels. The example of FIG. 2C may illustrate a light pattern from a pixel-matrix, or a pixel group within a larger pixel-matrix that may include a bright zone 206, a less bright zone 208 and a darker zone 209. The light pattern from FIG. 2C may combine with light patterns from other pixel-matrices on vehicle 204 to form light pattern 202, described above in relation to FIG. 2B.

FIG. 2D is a table illustrating an example pixel-matrix duty-cycle map 210 with a plurality of duty-cycle values 212 that may be used to generate the light pattern as depicted in FIGS. 2B and 2C. Duty-cycle map 210 may be sent by BCM 150 via video interface 106 to LED unit 101 as described above in relation to FIG. 1. The example of duty cycle map 210 may output the light pattern described above in relation to FIG. 2C. Duty cycle map 210 may include ten columns 214 and eight rows 216 of duty cycle values 212. Each duty cycle value may correspond to a pixel of a pixel-matrix, or a pixel-matrix group of a larger pixel-matrix for vehicle 204. Duty cycle map 210 includes duty cycles based on a 10-bit resolution PWM period ($2^{10}$). Around the edges of duty cycle map 210, the duty cycles are zero or other low duty cycle values indicating a darker zone, corresponding to darker zone 209 depicted in FIG. 2C. Bright zone 206 may correspond to higher duty cycle values, e.g. 900 and 1020, which may cause the switches that control the associated LED pixel to be on for 900 or 1020 of the 1024 counts for a 10-bit PWM period.

FIG. 3 is a table illustrating an example fixed phase shift map 300 based on a pixel geometrical position of a pixel-matrix according to one or more techniques of this disclosure. Each entry 302 in fixed phase shift map 300 may associated with each respective pixel in an LED pixel-matrix (not shown in FIG. 3) according to a geometrical position of each respective pixel in the LED pixel-matrix. In the example of FIG. 3, fixed phase shift map 300 has sixteen columns 306 (numbered 0-15), and eight rows 304, numbered (0-7).

The phase shift values 302 in fixed phase shift map 300 may be generated, for example, by equations [1] and [2] described above in relation to FIG. 1. However, equations [1] and [2] are just one example technique to generate the values of fixed phase shift map 300. Equations [1] and [2] may be desirable for generating a fixed phase shift map for a vehicle headlight. However, in other examples, such as for a building light, display lighting, stage lighting, and other applications, other techniques may be desirable to generate a fixed phase shift map.

In some examples, processing circuitry, such as processing circuitry included in PWM engine 110, may apply fixed phase shift map 300 to the received pixel-matrix duty-cycle map from BCM 150 as described above in relation to FIG. 1. For example, PWM engine 110 may apply a fixed phase shift map, such as fixed phase shift map 300 to a received pixel-matrix duty-cycle map similar to duty cycle map 210 described above in relation to FIG. 2D to generate a pixel driving matrix, such as pixel driving matrix 108 described above in relation to FIG. 1. In a practical application, the fixed phase shift map and the pixel-matrix duty-cycle map should have the same number of rows and columns to generate a pixel driving matrix of shifted duty-cycle values.

Figure 4:
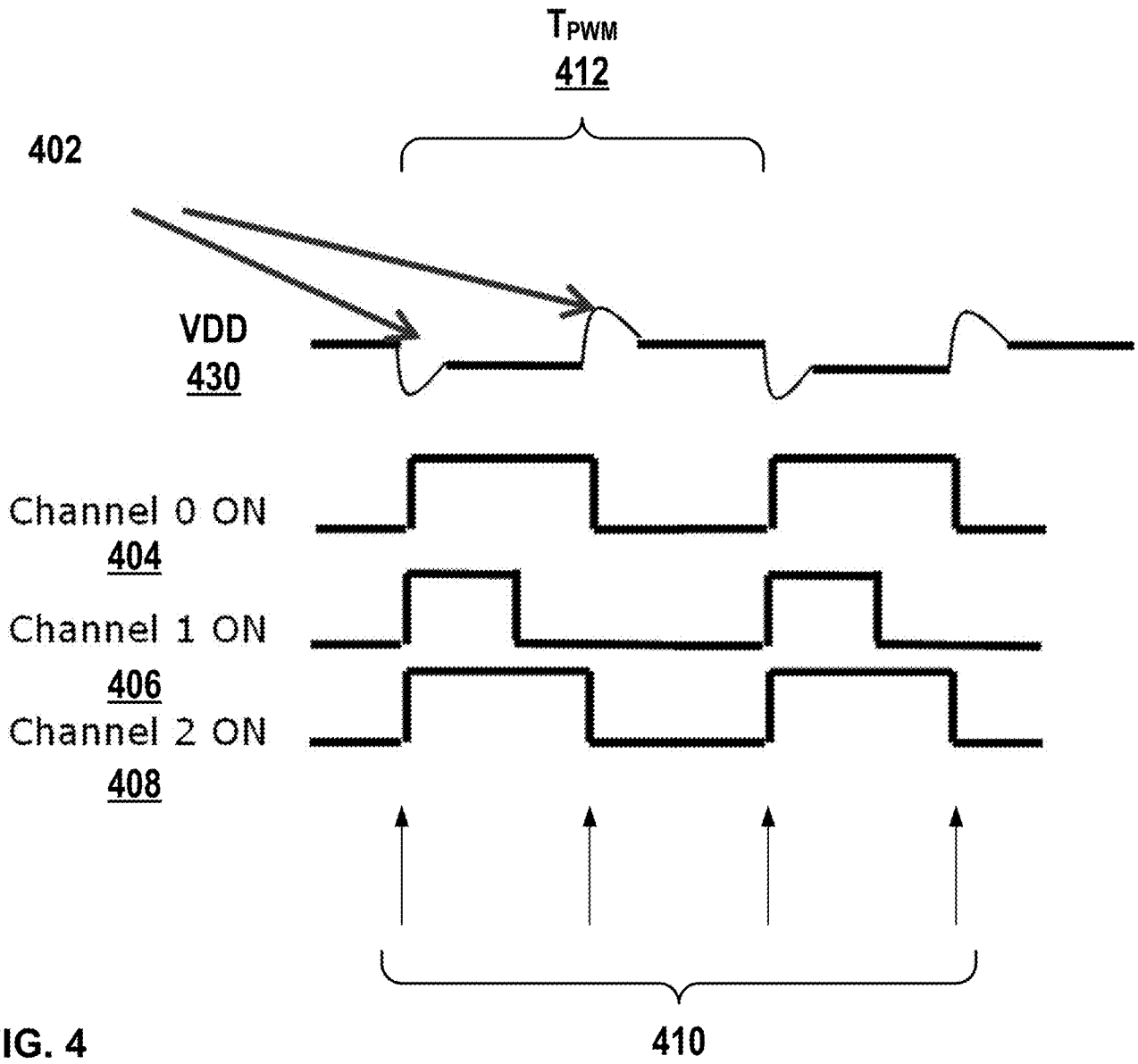
FIG. 4 is a timing diagram illustrating voltage excursions caused by a PWM scheme without an added phase shift.

FIG. 4 is a timing diagram illustrating voltage excursions caused by a PWM scheme without an added phase shift. In contrast to the techniques of this disclosure, the timing diagram of FIG. 4 depicts three channels of driver circuits in which the on-time for each pixel driven by the channel starts at approximately the same time.

The duty cycle for channel 0 404 and channel 2 408, in the example of FIG. 4 is approximately 50%, or approximately 128 counts for an 8-bit PWM period ($T_{PWM}$ 412). Channel 1 406 is approximately 30% or 85 counts. When all three channels turn on, and when channel 0 404 and channel 2 408 turn off at approximately the same time, the voltage Vdd 430 of the power supply may develop voltage transients (402) as the power supply tries to handle the large and fast load steps (dI/dt) at the points indicated by 410. As describe above in relation to FIG. 1, the transients may cause voltage and current ripple, which may introduce electromagnetic interference (EMI) and other undesirable effect.

Figure 5A:
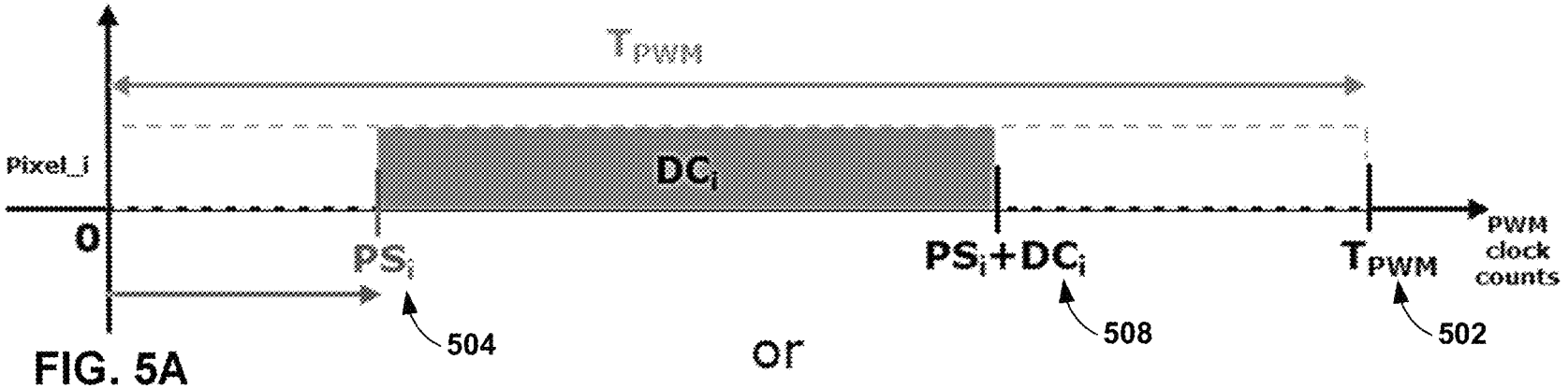
FIGS. 5A and 5B are timing diagrams illustrating techniques to apply a fixed phase shift according to one or more techniques of this disclosure.
Figure 5B:
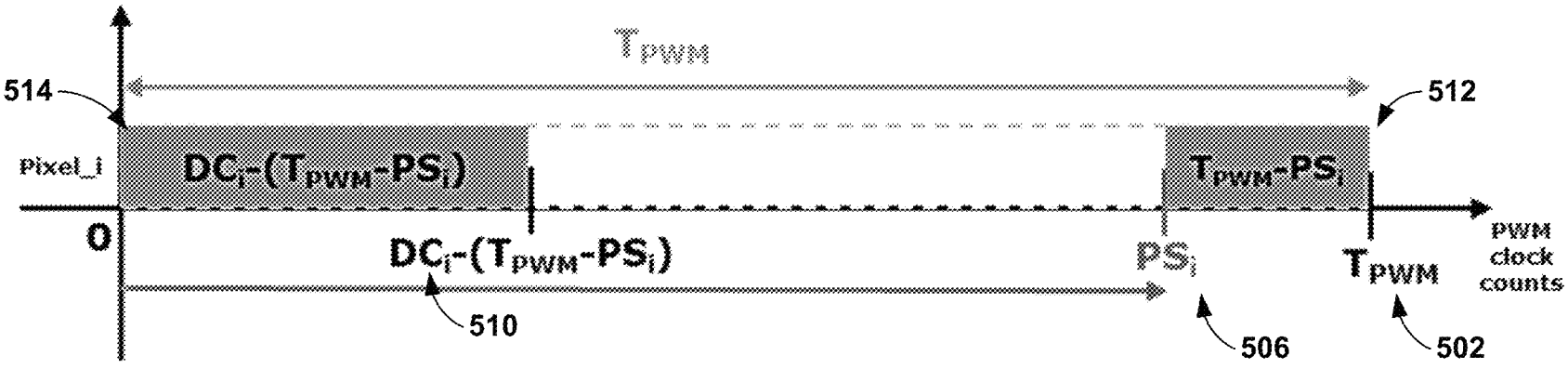

FIGS. 5A and 5B are timing diagrams illustrating techniques to apply a fixed phase shift according to one or more techniques of this disclosure. The applied technique may depend on whether the length of the phase shift plus the duty cycle is greater or less than the PWM period ($T_{PWM}$ 502).

In FIGS. 5A and 5B, PSi 504 and PSi 506 may be the calculated phase shift for a selected pixel geometrical position. In other words, PSi 504 and PSi 506 may be the respective entry in the fixed phase shift map associated with the respective pixel in the LED pixel-matrix according to the geometrical position of the respective pixel in the LED pixel-matrix. PSi 504 and PSi 506 are equivalent to entries 302 in fixed phase shift map 300 as described above in FIG. 3. Also, PSi 504 and PSi 506 may be generated, for example, by equations [1] and [2] described above in relation to FIG. 1.

Also, in FIGS. 5A and 5B, DCi 508 and DCi 510 may be a respective duty-cycle duration for a selected pixel geometrical position. DCi 508 and DCi 510 are equivalent to duty cycle values 212 in duty cycle map 210 as described above in FIG. 2D. Also, as described above in relation to FIG. 1, DCi 508 and DCi 510 may be corrected, e.g. with a gamma correction and converted to a higher resolution (e.g. 8-bit to 10-bit) by signal processing circuitry 104.

FIG. 5A depicts applying the fixed phase shift map to the pixel-matrix duty-cycle map in which for the respective duty-cycle value $(PSi+DCi)<T_{PWM}$. In response to determining that $(PSi+DCi)<T_{PWM}$, LED control circuitry 102, depicted in FIG. 1, may the phase shift PSi 504 to the respective duty-cycle value DCi 508 to result in a respective shifted duty-cycle value. The respective shifted duty cycle value may be output to LED driver unit 140 as pixel driving matrix 108, as described above in relation to FIG. 1.

FIG. 5A depicts applying the fixed phase shift map to the pixel-matrix duty-cycle in which for the respective duty-cycle value (PSi 506+DCi 510)>$T_{PWM}$ 502. In response to $(PSi+DCi)>T_{PWM}$. LED control circuitry 102 may apply the phase shift to the respective duty-cycle value for the received image by applying the phase shift in two segments. The LED control circuitry may apply the phase shift to a first segment 512 of the duty-cycle value, in which the first segment 512 is: $T_{PWM}$ 502−PSi 506. The LED control circuitry may apply a zero phase shift to a second segment 514 of the duty-cycle value, wherein the second segment comprises: DCi 510−($T_{PWM}$ 502−PSi 506). The two segments 512 and 514 of the respective shifted duty cycle value may be output to LED driver unit 140 as an entry in the pixel driving matrix. In this manner the techniques of this disclosure may apply a phase shift to level the current demand over a PWM period, without corrupting or changing the duty cycle for each pixel of the received image.

Figure 6A:
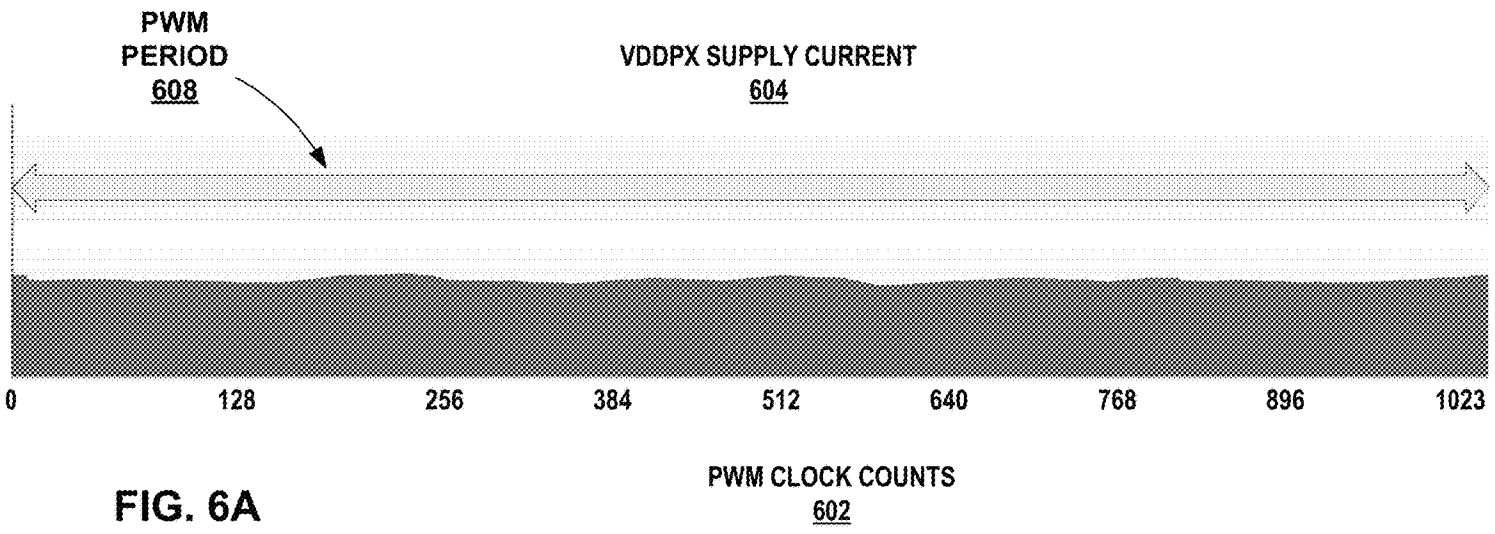
FIGS. 6A and 6B are timing diagrams illustrating the impact on changes in current over time based on applying the fixed phase shift map according to one or more techniques of this disclosure.
Figure 6B:
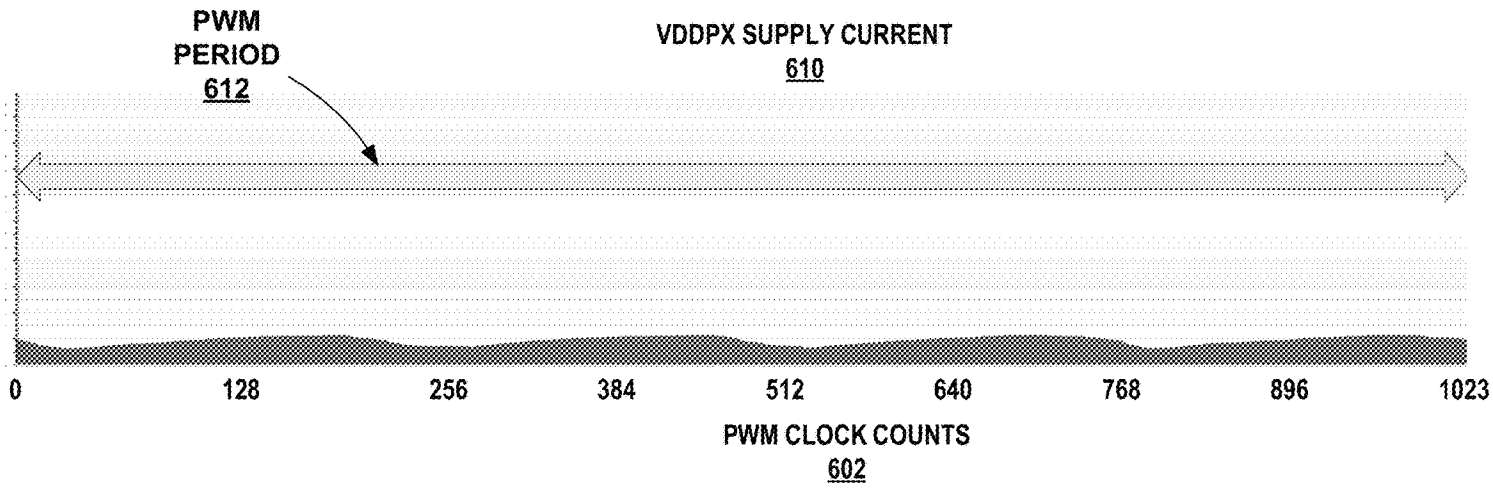

FIGS. 6A and 6B are timing diagrams illustrating the impact on changes in current over time based on applying the fixed phase shift map according to one or more techniques of this disclosure. FIGS. 6A and 6B depict the current over a PWM period ($T_{PWM}$) without a current spike at the beginning of the PWM period, such as would be expected for different techniques, as described above in relation to FIG. 4.

The example of FIG. 6A illustrates an example of the resulting supply current considering a matrix segment of 64×64 LED drivers located in the middle right position of a larger LED pixel-matrix on a vehicle. The larger pixel-matrix on the vehicle in the example of FIGS. 6A and 6B is in high resolution high beam headlight mode. Over the PWM period 608, which in the example of FIGS. 6A and 6B, is a 10-bit PWM period, the Vddpx supply current 604 shows a few ripples over PWM period 608, but without large current excursions (dI/dt).

The example of FIG. 6B illustrates an example of the resulting supply current considering a matrix segment of 64×64 LED drivers located in the right position of the larger LED pixel-matrix on the same vehicle. In high beam headlight mode, the right matrix segment may output a portion of the darker region of the light pattern, similar to darker zone 209 described above in relation to FIG. 2C. Vddpx supply current 610 also does not include larger current excursions, such as at the beginning of PWM period 612, nor the middle, as may be seen in a center based PWM scheme. Vddpx supply current 610 also shows a lower magnitude as clock counts 602 progress through PWM period 612, when compared to Vddpx supply current 604 depicted in FIG. 6A.

Figure 7:
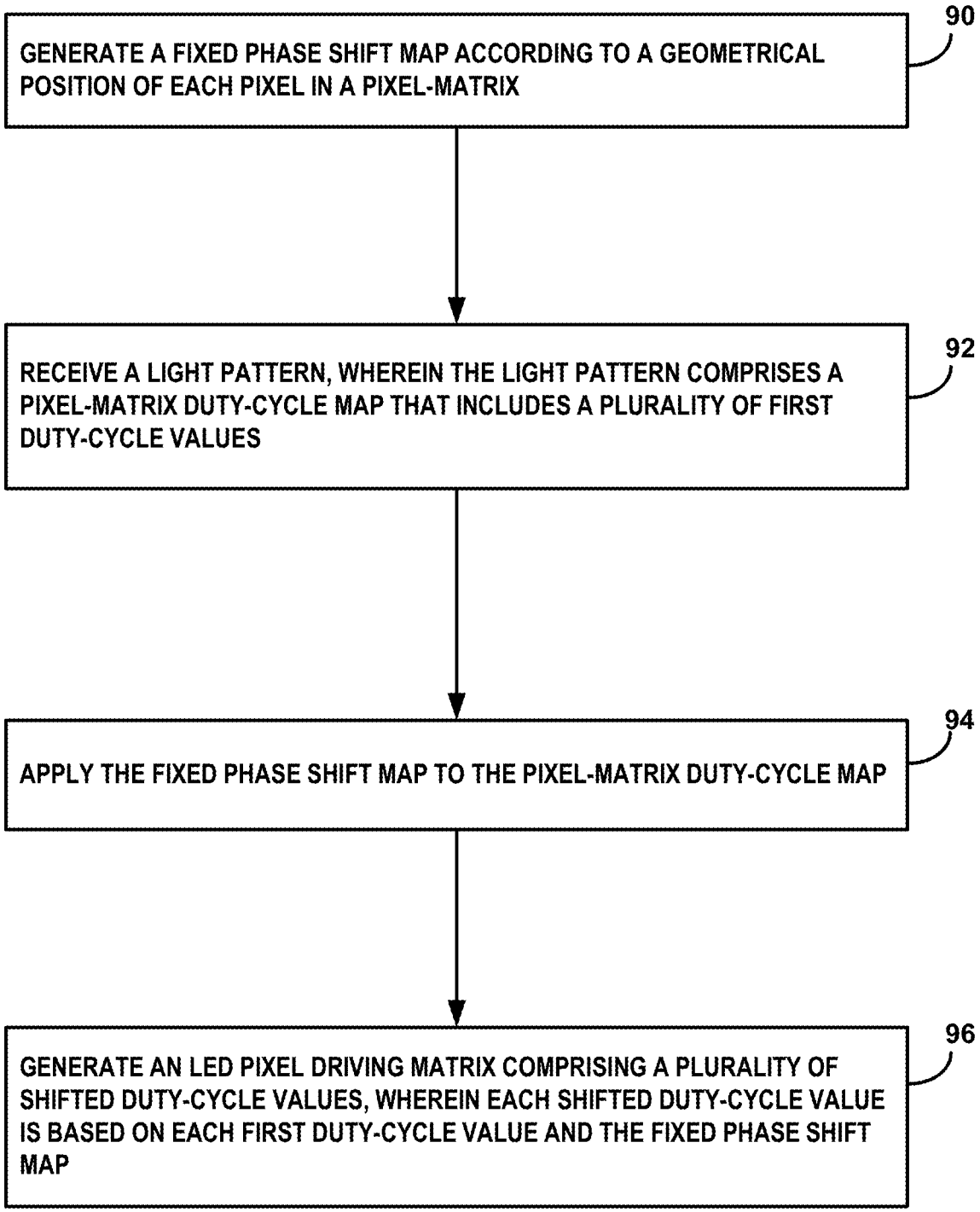
FIG. 7 is a flow chart illustrating an example operation of LED driver circuitry according to one or more techniques of this disclosure.

FIG. 7 is a flow chart illustrating an example operation of LED driver circuitry according to one or more techniques of this disclosure. The blocks of FIG. 7 will be described in terms of FIG. 1, unless otherwise noted.

Processing circuitry may generate a fixed phase shift map according to a geometrical position of each pixel in a pixel-matrix (90). In some examples, such as for a vehicle headlight application, processing circuitry may be used in a manufacturing setting to generate the fixed phase shift map, such as fixed phase shift map 300 described above in relation to FIG. 3. Each entry in fixed phase shift map is based on a phase shift associated with each pixel geometrical position according to, for example equations [1] and [2] described above in relation to FIG. 1. In other examples, such as building lighting, processing circuitry may generate the fixed phase shift map based in part on the types of expected light patterns as well as the size and arrangement of the pixel-matrix. In other examples, processing circuitry within LED control circuitry 102, such as PWM engine 110 or processors 120 may generate the pixel-matrix. The fixed phase shift map, for example, may be stored in memory 122 in the example of FIG. 1.

LED control circuitry 102 may receive a light pattern, such as from BCM 150 via video interface 106. The signals from BCM 150 may include a light pattern defined by a pixel-matrix duty-cycle map that includes a plurality of duty-cycle values 116 (92). In some examples, the duty cycle values in the pixel-matrix duty-cycle map may first be corrected, such as by a gamma correction, before being sent to PWM engine 110. In addition to a correction, in some examples the received pixel-matrix duty-cycle map may be converted to a different resolution. In the example of FIG. 1, signal processing 104 may perform any corrections and conversions before PWM engine 110 receives the pixel-matrix duty-cycle map.

PWM engine 110 may apply the fixed phase shift map to the pixel-matrix duty-cycle map (94). In the example of FIG. 1, PWM engine 110 may apply the fixed phase shift map to the corrected and converted duty cycle values in the pixel-matrix duty-cycle map received from BCM 150. As described above in relation to FIGS. 1 and 3, each entry 302 in the fixed phase shift map may be associated with a respective pixel in an LED pixel-matrix. Also, each respective pixel is associated with a respective pixel driver circuit, such as the pixel driver circuits of LED driver unit 140 described above in relation to FIG. 1.

PWM engine 110 of LED control circuitry 102 may generate pixel driving matrix 108, which may include a plurality of shifted duty-cycle values (96). Each shifted duty-cycle value pixel driving matrix 108 may be based on each corrected and converted duty-cycle 116 value and the applied fixed phase shift map 300. The techniques of this disclosure may apply to the example circuitry of FIG. 1 even without LED matrix 142. In other words, the pixel driving matrix 108 may cause switches 144 to open and close with the phase shifted timing of this disclosure, whether or not the driver circuits of LED driver unit 140 are connected to LED matrix 142.

In one or more examples, the functions described above may be implemented in hardware, software, firmware, or any combination thereof. For example, the various components of FIG. 1, such as PWM engine 110, signal processing circuitry 104 and processors 120 may be implemented in hardware, software, firmware, or any combination thereof. If implemented in software, the functions may be stored on a tangible computer-readable storage medium, such as memory 122, and executed by a processor or hardware-based processing unit.

Instructions may be executed by one or more processors, such as one or more digital signal processors (DSPs), general purpose microprocessors, application specific integrated circuit (ASIC), Field programmable gate array (FPGAs), or other equivalent integrated or discrete logic circuitry. Accordingly, the term "processor," and "processing circuitry" as used herein, such as may refer to any of the foregoing structure or any other structure suitable for implementation of the techniques described herein. Also, the techniques could be fully implemented in one or more circuits or logic elements.

The techniques of this disclosure may be implemented in a wide variety of devices or apparatuses, including a wireless handset, an IC or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperative hardware units, including one or more processors as described The techniques of this disclosure may also be described in the following examples.

Example 1. A method comprising: receiving, by light emitting diode (LED) control circuitry, a light pattern, wherein the light pattern comprises a pixel-matrix duty-cycle map that includes a plurality of first duty-cycle values, and applying, by the LED control circuitry, a fixed phase shift map to the pixel-matrix duty-cycle map. Each entry in the fixed phase shift map is associated with a respective pixel in an LED pixel-matrix, and wherein each respective pixel is associated with a respective pixel driver circuit. The method further comprises generating, by the LED control circuitry, a pixel driving matrix comprising a plurality of shifted duty-cycle values, wherein each shifted duty-cycle value is based on each first duty-cycle value and the applied fixed phase shift map.

Example 2. The method of example 1, further comprising generating the fixed phase shift map by calculating a phase shift for each pixel geometrical position in the LED pixel-matrix according to:

$$\text{Phase_Shift}_{x,y}=F3[F1(x)+F2(y)]$$

wherein for each pixel geometrical position (x,y):

x indicates a row of the pixel geometrical position, y indicates a column of the pixel geometrical position, F1(x) comprises a first function based on a pixel row position, F2(y) comprises a second function based on a pixel column position, and F3[ . . . ] comprises a third function.

Example 3. The method of any combination of examples 1-2, wherein generating the fixed phase shift map comprises calculating a phase shift for each pixel geometrical position according to:

$$\text{Phase_Shift}_{x,y} = \text{mod}\left[\left(x*\Delta PS_x + y*\Delta PS_y + \frac{\text{mod}(y, 2^A)}{4}\right) + \Delta PS_{cycle}, 2^B\right]$$

wherein for each pixel geometrical position (x,y):

ΔPScycle is a dynamic correction of phase shift for each PWM cycle . . . .

ΔPSx indicates a constant phase shift change for each row,

ΔPSy indicates a constant phase shift change for each column.

mod(M,N) comprises a modulus of M divided by N, $2^A$ indicates a quantity of pixels in a row, and $2^B$ indicates a quantity of pixels in a column.

Example 4. The method of any combination of examples 1-3, wherein ΔPScycle=zero.

Example 5. The method of any combination of examples 1-4, wherein the pixel-matrix duty-cycle map is based on a pulse-width modulation (PWM) period ($T_{PWM}$).

Example 6. The method of any combination of examples 1-5, wherein applying the fixed phase shift map to the pixel-matrix duty-cycle map comprises for each respective first duty-cycle value: in response to $(PSi+DCi)<T_{PWM}$, applying the phase shift to the respective first duty-cycle value to result in a respective shifted duty-cycle value, wherein: PSi comprises a calculated phase shift for a selected pixel geometrical position, and DCi comprises a first duty-cycle duration for the selected pixel geometrical position.

Example 7. The method of any combination of examples 1-6, wherein applying the fixed phase shift map to the pixel-matrix duty-cycle map comprises for each respective first duty-cycle value: in response to $(PSi+DCi)>T_{PWM}$, wherein PSi is a calculated phase shift for a selected pixel geometrical position, and DCi is a first duty-cycle duration for the selected pixel geometrical position: applying the phase shift to a first segment of the first duty-cycle value, wherein the first segment comprises $T_{PWM}-PSi$, and applying zero phase shift to a second segment of the first duty-cycle value, wherein the second segment comprises: $DCi-(T_{PWM}-PSi)$.

Example 8. The method of any combination of examples 1-7, wherein the LED control circuitry receives the light pattern at every refresh period.

Example 9. The method of any combination of examples 1-8, wherein further comprising processing by the LED control circuitry, each original duty-cycle value in the received pixel-matrix duty-cycle map, wherein processing comprises adding one or more corrections to each of the plurality of original duty-cycle values.

Example 10. The method of any combination of examples 1-9, wherein, further comprising converting (104) each original duty-cycle value in the received pixel-matrix duty-cycle map to a second duty-cycle value, wherein the second duty-cycle values have a higher resolution than the original duty-cycle values.

Example 11. A circuit comprising: an input interface configured to receive a signal comprising a light pattern, wherein the light pattern comprises a pixel-matrix duty-cycle map for an LED pixel matrix that includes a plurality of first duty-cycle values, a plurality of pixel driver circuits, wherein each pixel driver circuit is associated with a respective pixel in the pixel matrix, processing circuitry configured to: apply a fixed phase shift map to the received pixel-matrix duty-cycle map. Each entry in the fixed phase shift map is associated with each respective pixel in the LED pixel-matrix according to a geometrical position of each respective pixel in the LED pixel-matrix. The processing circuitry is further configured to generate a pixel driving matrix comprising a plurality of shifted duty-cycle values, wherein each shifted duty-cycle value is based on each first duty-cycle value and the fixed phase shift map, and output the pixel driving matrix (108) to the plurality of pixel driver circuits.

Example 12. The circuit of example 11, wherein each entry in fixed phase shift map is based on a phase shift associated with each pixel geometrical position according to:

$$\text{Phase_Shift}_{x,y} = \text{mod}\left[\left(x * \Delta PS_x + y * \Delta PS_y + \frac{\text{mod}(y, 2^A)}{4}\right) + \Delta PS_{cycle}, 2^B\right]$$

wherein for each pixel geometrical position (x,y):

x indicates a row of the pixel geometrical position, y indicates a column of the pixel geometrical position.

ΔPScycle is a dynamic correction of phase shift for each PWM cycle.

ΔPSx indicates a constant phase shift change for each row,

ΔPSy indicates a constant phase shift change for each column.

mod(M,N) comprises the modulus of M divided by N, $2^A$ indicates a quantity of pixels in a row, and $2^B$ indicates a quantity of pixels in a column.

Example 13. The circuit of any combination of examples 11-12, wherein ΔPScycle=zero.

Example 14. The circuit of any combination of examples 11-14, wherein the pixel-matrix duty-cycle map is based on a pulse-width modulation (PWM) period ($T_{PWM}$).

Example 15. The circuit of any combination of examples 11-15, wherein to apply the fixed phase shift map to the pixel-matrix duty-cycle map comprises for each respective first duty-cycle value: in response to $(PSi+DCi)<T_{PWM}$, applying the phase shift to the respective first duty-cycle value to result in a respective shifted duty-cycle value, wherein: PSi comprises a calculated phase shift for a selected pixel geometrical position, and DCi comprises a first duty-cycle duration for the selected pixel geometrical position.

Example 16. The circuit of any combination of examples 11-15, wherein to apply the fixed phase shift map to the pixel-matrix duty-cycle map comprises for each respective first duty-cycle value: in response to $(PSi+DCi)>T_{PWM}$, wherein PSi is a calculated phase shift for a selected pixel geometrical position, and DCi is a respective first duty-cycle duration for the selected pixel geometrical position: applying the phase shift to a first portion of the first duty-cycle value, wherein the first portion comprises $T_{PWM}$−PSi, and applying zero phase shift to a second portion of the first duty-cycle value, wherein the second portion comprises: DCi−($T_{PWM}$−PSi).

Example 17. The circuit of any combination of examples 11-16, further comprising signal processing circuitry (104), configured to: add one or more corrections to each first duty-cycle value and converting each first duty-cycle value to a second duty-cycle value, wherein the second duty-cycle value has a higher resolution than the first duty-cycle value.

Example 18. A system comprising: a controller unit (BCM 150) configured to output a signal comprising a light pattern, a light emitting diode (LED) unit comprising a plurality of pixel driver circuits, wherein each pixel driver circuit is associated with a respective pixel in the pixel matrix, and LED control circuitry comprising: an input interface configured to receive the signal comprising the light pattern, wherein the light pattern includes a pixel-matrix duty-cycle map with a plurality of first duty-cycle values, and processing circuitry configured to: apply a fixed phase shift map to each first duty-cycle value of the plurality of first duty cycle values. Each entry in the fixed phase shift map is associated with each respective pixel in the LED pixel-matrix according to a geometrical position of each respective pixel in the LED pixel-matrix. The processing circuitry is further configured to generate a pixel driving matrix comprising a plurality of shifted duty-cycle values, wherein each shifted duty-cycle value is based on each first duty-cycle value and the fixed phase shift map, and output the pixel driving matrix, to the plurality of pixel driver circuits.

Example 19. The system of example 18, wherein each entry in the fixed phase shift map is based on a phase shift associated with each pixel geometrical position according to:

$$\text{Phase_Shift}_{x,y} = \text{mod}\left[\left(x * \Delta PS_x + y * \Delta PS_y + \frac{\text{mod}(y, 2^A)}{4}\right) + \Delta PS_{cycle}, 2^B\right]$$

wherein for each pixel geometrical position (x,y):

x indicates a row of the pixel geometrical position, y indicates a column of the pixel geometrical position, ΔPScycle is a dynamic correction of phase shift for each PWM cycle, ΔPSx comprises a constant phase shift change for each row, ΔPSy comprises a constant phase shift change for each column, mod(M,N) comprises calculate the modulus of M divided by N, $2^A$ indicates a quantity of pixels in a row, and $2^B$ indicates a quantity of pixels in a column.

Example 20. The system of any combination of examples 18-19, wherein the LED control circuitry comprises a pulse width modulation (PWM) engine, and wherein the PWM engine is configured to: store the fixed phase shift map, apply the fixed phase shift map to the pixel-matrix duty-cycle map to generate the pixel driving matrix comprising the plurality of shifted duty-cycle values.

Example 21. The system of any combination of examples 18-20, wherein the plurality of pixel driver circuits of the LED unit comprises a plurality of switches, wherein: a respective switch is electrically coupled to a respective pixel of the pixel matrix, a brightness output of each respective pixel of the pixel matrix is based on the shifted duty-cycle value associated with each pixel as defined by the pixel driving matrix.

Various examples of the disclosure have been described. These and other examples are within the scope of the following claims.

What is claimed is:

1. A method comprising:

receiving, by light emitting diode (LED) control circuitry, a light pattern, wherein the light pattern comprises a pixel-matrix duty-cycle map that includes a plurality of first duty-cycle values;

applying, by the LED control circuitry, a fixed phase shift map to the pixel-matrix duty-cycle map, wherein each entry in the fixed phase shift map is associated with a respective pixel in an LED pixel-matrix, and wherein each respective pixel is associated with a respective pixel driver circuit; and generating, by the LED control circuitry, a pixel driving matrix comprising a plurality of shifted duty-cycle values, wherein each shifted duty-cycle value is based on each first duty-cycle value and the applied fixed phase shift map.

2. The method of claim 1, further comprising generating the fixed phase shift map by calculating a phase shift for each pixel geometrical position in the LED pixel-matrix according to:

$$\text{Phase_Shift}_{x,y}=F3[F1(x)+F2(y)]$$

wherein for each pixel geometrical position (x,y):

x indicates a row of the pixel geometrical position, y indicates a column of the pixel geometrical position, F1(x) comprises a first function based on a pixel row position, F2(y) comprises a second function based on a pixel column position, and F3[ . . . ] comprises a third function.

3. The method of claim 2, wherein generating the fixed phase shift map comprises calculating a phase shift for each pixel geometrical position according to:

$$\text{Phase_Shift}_{x,y} = \text{mod}\left[\left(x*\Delta PS_x + y*\Delta PS_y + \frac{\text{mod}(y;2^A)}{4}\right) + \Delta PS_{cycle};2^B\right]$$

wherein for each pixel geometrical position (x,y):

ΔPScycle is a dynamic correction of phase shift for each PWM cycle,

ΔPSx indicates a constant phase shift change for each row,

ΔPSy indicates a constant phase shift change for each column, mod(M;N) comprises a modulus of M divided by N, $2^A$ indicates a quantity of pixels in a row, and $2^B$ indicates a quantity of pixels in a column.

4. The method of claim 3, wherein ΔPScycle=zero.

5. The method of claim 1, wherein the pixel-matrix duty-cycle map is based on a pulse-width modulation (PWM) period ($T_{PWM}$).

6. The method of claim 5, wherein applying the fixed phase shift map to the pixel-matrix duty-cycle map comprises for each respective first duty-cycle value:

in response to (PSi+DCi)<$T_{PWM}$, applying the phase shift to the respective first duty-cycle value to result in a respective shifted duty-cycle value, wherein:

PSi comprises a calculated phase shift for a selected pixel geometrical position, and DCi comprises a first duty-cycle duration for the selected pixel geometrical position.

7. The method of claim 5, wherein applying the fixed phase shift map to the pixel-matrix duty-cycle map comprises for each respective first duty-cycle value:

in response to (PSi+DCi)>$T_{PWM}$, wherein PSi is a calculated phase shift for a selected pixel geometrical position, and DCi is a first duty-cycle duration for the selected pixel geometrical position:

applying the phase shift to a first segment of the first duty-cycle value, wherein the first segment comprises $T_{PWM}$−PSi, and applying zero phase shift to a second segment of the first duty-cycle value, wherein the second segment comprises: DCi−($T_{PWM}$−PSi).

8. The method of claim 1, wherein the LED control circuitry receives the light pattern at every refresh period.

9. The method of claim 1, further comprising processing by the LED control circuitry, each original duty-cycle value in the received pixel-matrix duty-cycle map, wherein processing comprises adding one or more corrections to each of the plurality of original duty-cycle values.

10. The method of claim 1, further comprising converting each original duty-cycle value in the received pixel-matrix duty-cycle map to a second duty-cycle value, wherein the second duty-cycle values have a higher resolution than the original duty-cycle values.

11. A circuit comprising:

an input interface configured to receive a signal comprising a light pattern, wherein the light pattern comprises a pixel-matrix duty-cycle map for an LED pixel matrix that includes a plurality of first duty-cycle values;

a plurality of pixel driver circuits, wherein each pixel driver circuit is associated with a respective pixel in the pixel matrix;

processing circuitry configured to:

apply a fixed phase shift map to the received pixel-matrix duty-cycle map, wherein each entry in the fixed phase shift map is associated with each respective pixel in the LED pixel-matrix according to a geometrical position of each respective pixel in the LED pixel-matrix;

generate a pixel driving matrix comprising a plurality of shifted duty-cycle values, wherein each shifted duty-cycle value is based on each first duty-cycle value and the fixed phase shift map; and output the pixel driving matrix to the plurality of pixel driver circuits.

12. The circuit of claim 11, wherein each entry in fixed phase shift map is based on a phase shift associated with each pixel geometrical position according to:

$$\text{Phase_Shift}_{x,y} = \text{mod}\left[\left(x*\Delta PS_x + y*\Delta PS_y + \frac{\text{mod}(y;2^A)}{4}\right) + \Delta PS_{cycle};2^B\right]$$

wherein for each pixel geometrical position (x,y):

x indicates a row of the pixel geometrical position, y indicates a column of the pixel geometrical position, ΔPScycle is a dynamic correction of phase shift for each PWM cycle, ΔPSx indicates a constant phase shift change for each row, ΔPSy indicates a constant phase shift change for each column, mod(M;N) comprises a modulus of M divided by N, $2^A$ indicates a quantity of pixels in a row, and $2^B$ indicates a quantity of pixels in a column.

13. The circuit of claim 12, wherein ΔPScycle=zero.

14. The circuit of claim 11, wherein the pixel-matrix duty-cycle map is based on a pulse-width modulation (PWM) period ($T_{PWM}$).

15. The circuit of claim 14, wherein to apply the fixed phase shift map to the pixel-matrix duty-cycle map comprises for each respective first duty-cycle value:

in response to (PSi+DCi)<$T_{PWM}$, applying the phase shift to the respective first duty-cycle value to result in a respective shifted duty-cycle value, wherein:

PSi comprises a calculated phase shift for a selected pixel geometrical position, and DCi comprises a first duty-cycle duration for the selected pixel geometrical position.

16. The circuit of claim 14, wherein to apply the fixed phase shift map to the pixel-matrix duty-cycle map comprises for each respective first duty-cycle value:

in response to (PSi+DCi)>$T_{PWM}$, wherein PSi is a calculated phase shift for a selected pixel geometrical position, and DCi is a respective first duty-cycle duration for the selected pixel geometrical position:

applying the phase shift to a first portion of the first duty-cycle value, wherein the first portion comprises $T_{PWM}$−PSi, and applying zero phase shift to a second portion of the first duty-cycle value, wherein the second portion comprises: DCi−($T_{PWM}$−PSi).

17. The circuit of claim 11, further comprising signal processing circuitry (104), configured to:

add one or more corrections to each first duty-cycle value and converting each first duty-cycle value to a second duty-cycle value, wherein the second duty-cycle value has a higher resolution than the first duty-cycle value.

18. A system comprising:

a controller unit configured to output a signal comprising a light pattern;

a light emitting diode (LED) unit comprising a plurality of pixel driver circuits, wherein each pixel driver circuit is associated with a respective pixel in the pixel matrix; and LED control circuitry comprising:

an input interface configured to receive the signal comprising the light pattern, wherein the light pattern includes a pixel-matrix duty-cycle map with a plurality of first duty-cycle values; and processing circuitry configured to:

apply a fixed phase shift map to each first duty-cycle value of the plurality of first duty cycle values, wherein each entry in the fixed phase shift map is associated with each respective pixel in the LED pixel-matrix according to a geometrical position of each respective pixel in the LED pixel-matrix;

generate a pixel driving matrix comprising a plurality of shifted duty-cycle values, wherein each shifted duty-cycle value is based on each first duty-cycle value and the fixed phase shift map; and output the pixel driving matrix, to the plurality of pixel driver circuits.

19. The system of claim 18, wherein each entry in the fixed phase shift map is based on a phase shift associated with each pixel geometrical position according to:

$$\text{Phase_Shift}_{x,y} = \text{mod}\left[\left(x * \Delta PS_x + y * \Delta PS_y + \frac{\text{mod}(y;\, 2^A)}{4}\right) + \Delta PS_{cycle};\, 2^B\right]$$

wherein for each pixel geometrical position (x,y):

x indicates a row of the pixel geometrical position, y indicates a column of the pixel geometrical position, ΔPScycle is a dynamic correction of phase shift for each PWM cycle, ΔPSx comprises a constant phase shift change for each row, ΔPSy comprises a constant phase shift change for each column, mod(M;N) comprises calculate a modulus of M divided by N, $2^A$ indicates a quantity of pixels in a row, and $2^B$ indicates a quantity of pixels in a column.

20. The system of claim 18, wherein the LED control circuitry comprises a pulse width modulation (PWM) engine, and wherein the PWM engine is configured to:

store the fixed phase shift map;

apply the fixed phase shift map to the pixel-matrix duty-cycle map to generate the pixel driving matrix comprising the plurality of shifted duty-cycle values.

21. The system of claim 18, wherein the plurality of pixel driver circuits of the LED unit comprises a plurality of switches, wherein:

a respective switch is electrically coupled to a respective pixel of the pixel matrix;

a brightness output of each respective pixel of the pixel matrix is based on the shifted duty-cycle value associated with each pixel as defined by the pixel driving matrix.

* * * * *